US007201376B2

(12) United States Patent
Kuosa

(10) Patent No.: US 7,201,376 B2
(45) Date of Patent: Apr. 10, 2007

(54) TARGET SYSTEM

(75) Inventor: Risto Kuosa, Helsinki (FI)

(73) Assignee: Honestas Oy, Helsinki (FI)

( * ) Notice: Subject to any disclaimer, the term of this patent is extended or adjusted under 35 U.S.C. 154(b) by 0 days.

(21) Appl. No.: 10/501,505

(22) PCT Filed: Jan. 9, 2003

(86) PCT No.: PCT/FI03/00014

§ 371 (c)(1),
(2), (4) Date: Jul. 15, 2004

(87) PCT Pub. No.: WO03/060417

PCT Pub. Date: Jul. 24, 2003

(65) Prior Publication Data

US 2005/0116421 A1 Jun. 2, 2005

(30) Foreign Application Priority Data

Jan. 17, 2002 (FI) ..... 20020091

(51) Int. Cl.
*F41J 7/04* (2006.01)

(52) U.S. Cl. ..... 273/392; 273/406

(58) Field of Classification Search ..... 273/390–392, 273/406, 407

See application file for complete search history.

(56) References Cited

U.S. PATENT DOCUMENTS

| | | | | |
|---|---|---|---|---|
| 1,640,954 | A | 8/1927 | Mach | |
| 3,064,976 | A | 11/1962 | Kuhn | |
| 4,397,466 | A * | 8/1983 | D'Andrade et al. | 273/381 |
| 4,732,394 | A | 3/1988 | Stein et al. | |
| 4,807,888 | A * | 2/1989 | Pidde et al. | 273/392 |
| 4,979,752 | A | 12/1990 | Fosseen | |

FOREIGN PATENT DOCUMENTS

| | | |
|---|---|---|
| FI | 111659 B | 8/2003 |

* cited by examiner

*Primary Examiner*—Mark S. Graham
(74) *Attorney, Agent, or Firm*—Birch, Stewart, Kolasch & Birch, LLP

(57) ABSTRACT

A target system for light infantry weapons including a target overturnable by an impact and an actuating mechanism configured to move the target. The target is connected to the actuating mechanism via a pivot structure. Further, the actuating mechanism includes a lifter configured to lift the target to a substantially upright position, a vertical rail system and a carriage vertically moveable along the vertical rail system, and an electric motor configured to move the carriage along the vertical rail system. Also, the pivot structure is arranged on the carriage, and the lifter includes a supporting lifter device, against which the target falls when hit and which, when the carriage is lowered, lifts the target to the substantially upright position utilizing the movement of the carriage and an inertia of the target. In addition, the target system is portable and of modular construction.

21 Claims, 3 Drawing Sheets

TARGET SYSTEM

BACKGROUND OF THE INVENTION

Figure 1A:
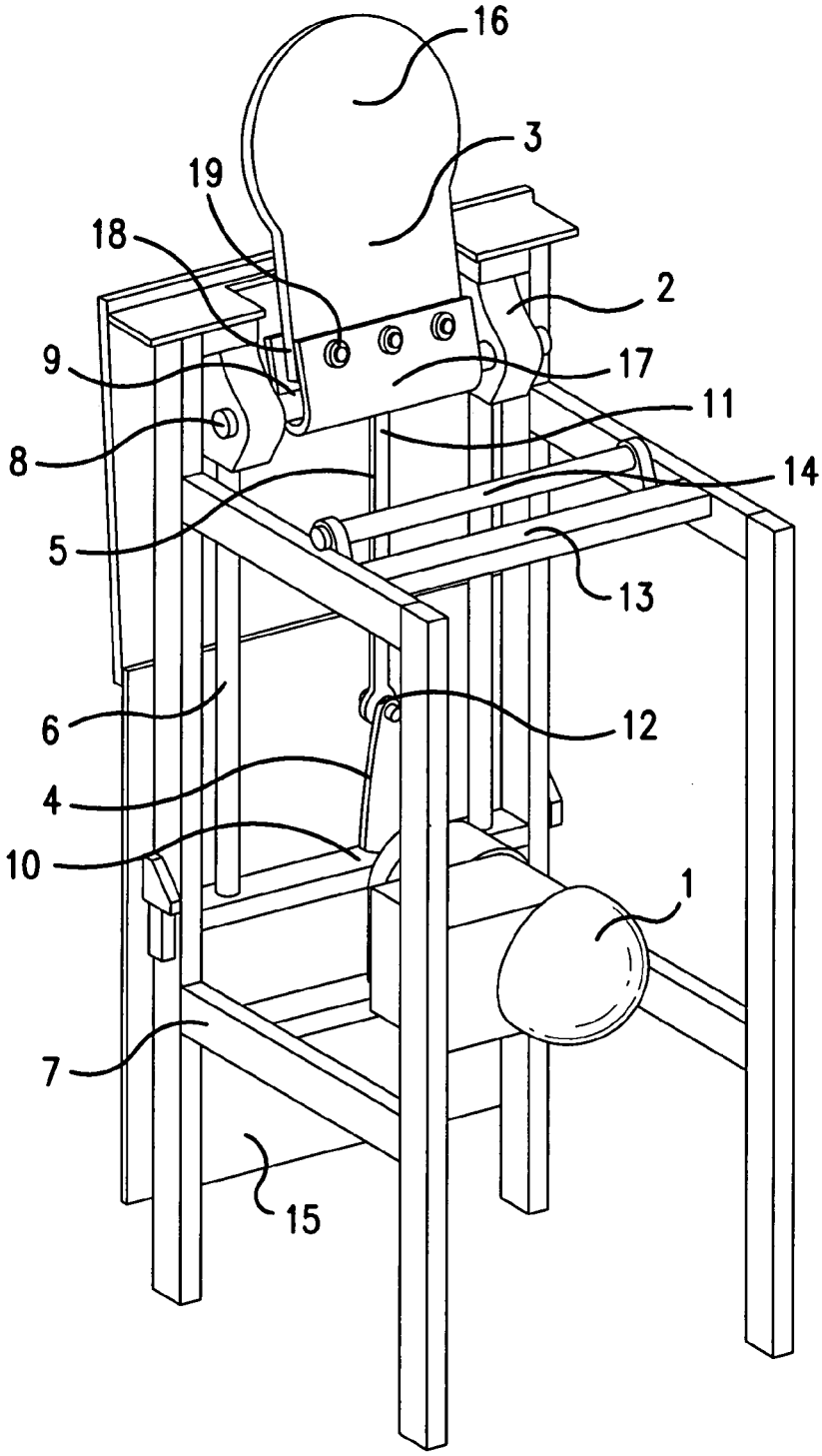

1. Field of the Invention.

The present invention relates to a target system provided with a pop-up target.

2. Discussion of the Background

Target systems with pop-up targets designed for light infantry weapons comprise a metallic target, which falls down when hit by a bullet, and an actuating mechanism for actuating the target, i.e. for lifting it up again and moving it. The actuating mechanism may be protected by a shield plate placed in front of it. To control the actuating mechanism, a control apparatus provided with a computer may be connected to the actuating mechanism. Hits can be detected e.g. by using a hit detector arranged in conjunction with the target.

The actuating mechanism may be electrically operated, but it may also be operated pneumatically. A drawback with pneumatic target systems is their large size, which means that moving them e.g. for transportation requires transport equipment, and in addition, they often have to be immovably installed. Moreover, in connection with relocation of pneumatic systems, e.g. the pneumatic hoses and protection against fragments have to be renewed.

An electrically operated target system provided with a pop-up target is disclosed in U.S. Pat. No. 4,732,394. The, system described in this specification, comprises a vertical protective flange on the front side and another, horizontal flange behind it. The target is hinged at the upper edge of the vertical flange, and when hit by a bullet, it swings backwards into a horizontal rest position. A main shaft driven by an electric motor is mounted behind the protective flange. Mounted with a clutch mechanism on this shaft is a target raising arm, which, when the target is in the backward position, swings from its rest position upwardly and turns the target to an upright position.

The system disclosed in the above US patent specification is relatively complicated. Moreover, it is relatively weak in construction e.g. because of the welded joints used in the target, so it will easily break and therefore does not tolerate hard use.

U.S. Pat. No. 4,979,752 discloses a target range apparatus for rifle and handgun targets having a knock-down target supported on a target base moveable on a support frame between an upper, exposed position and a lower, hidden position. The target is pivotally attached to the target frame for movement between an upright position and a knock-down position. An air cylinder moves the target base upwardly against a pair of springs which, when the air cylinder is disabled, return the target base to the lower position. A reed switch senses movement of the target to the knock-down position and disables the air cylinder. Upon movement of the target base to the lower position, a reset arm returns the target to its upright position. The apparatus further includes a support frame embedded in the ground and a target base on which is pivotally mounted a target that in the preferred embodiment is an animal silhouette.

The problem of the prior art as shown in U.S. Pat. No. 4,979,752 is the heavy and bulky construction of the apparatus, especially as the actuating means include an air

SUMMARY OF THE INVENTION

The object of the present invention is to overcome the drawbacks of prior art and to achieve a new type of target system provided with a pop-up target and actuated by an electric motor, which system is of very durable design and is additionally of modular construction.

In the target system of the invention, the target is attached to a carriage which moves on upright guide rails and is driven by an electrically operated actuating mechanism. When the carriage is driven up, the target is in an upright position and visible to the shooter. When the shooter hits the target, it falls down and disappears from view. The electric motor draws the carriage down, with the result that the target hits a lifter and rises to an upright position again. The carriage remains in the low position hidden behind a protective armour, ready to raise the target again.

The target system of the invention is very simple and durable, especially because welded joints have been eliminated from the parts subject to stress, thus achieving a durable construction. In addition, the target system of the invention is of light weight, so it can be portable, and no special transport equipment is needed for relocation of the target system. Thanks to the modular construction, individual parts are of light weight, typically below 20 kg, and e.g. broken or worn parts can be replaced in a rapid and simple manner. Thus, if necessary, a single person can move, assemble and disassemble the target system.

Moreover, the target system of the invention makes it possible to implement a reactive and relocatable target system that can be used e.g. with a large variety of portable-firearm calibers.

BRIEF DESCRIPTION OF THE INVENTION

In the following, the invention will be described in detail with reference to and example and the attached drawings, wherein FIG. 1*a* presents an oblique rear view of a target system according to the FIG. 1*b* a front view of a target system according to the invention without front armour, and FIG. 2*a*–2*d* present a target system according to the invention in different positions.

DETAILED DESCRIPTION OF THE PREFERRED EMBODIMENTS

Figure 1B:
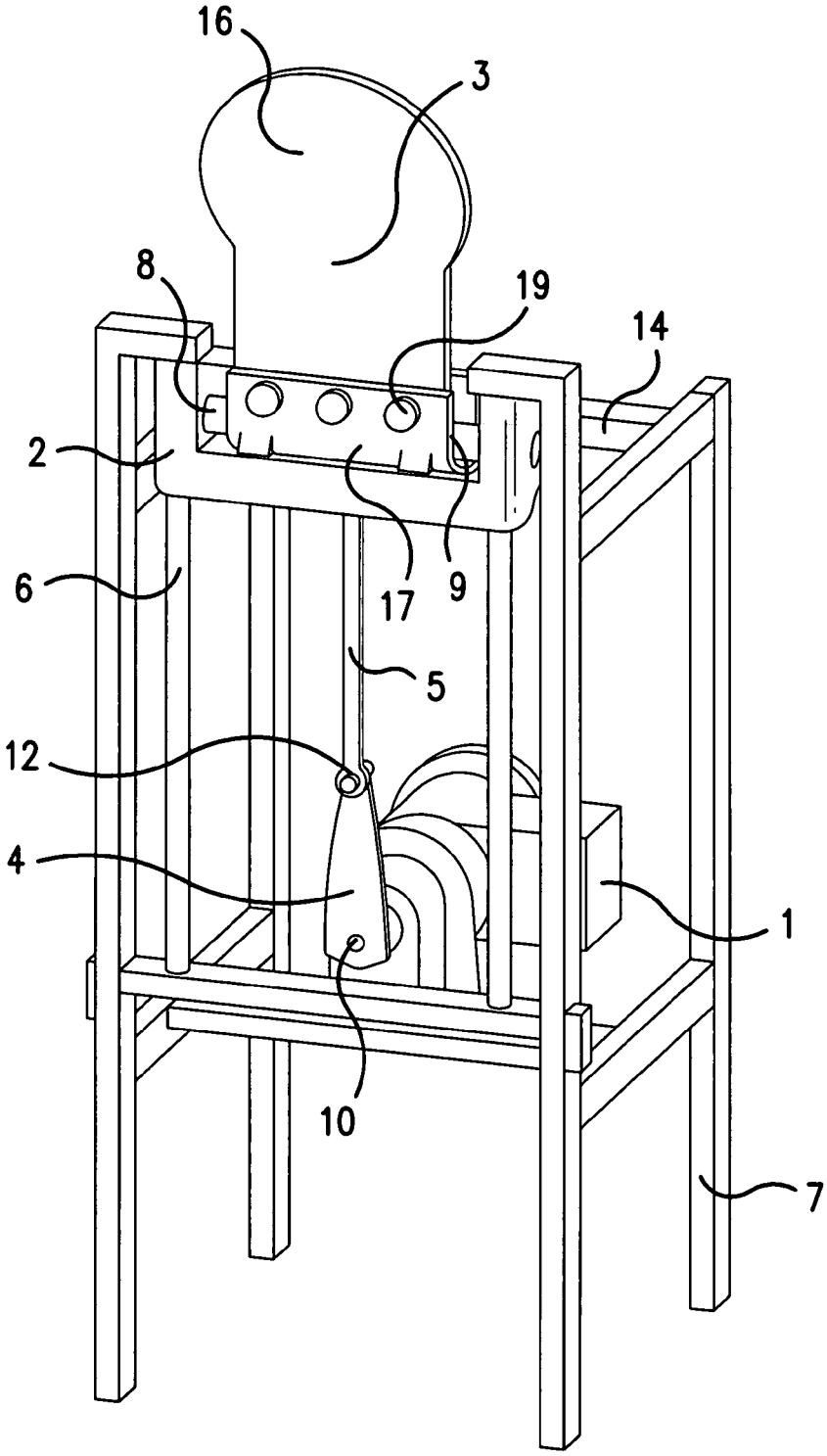
Figure 2B:
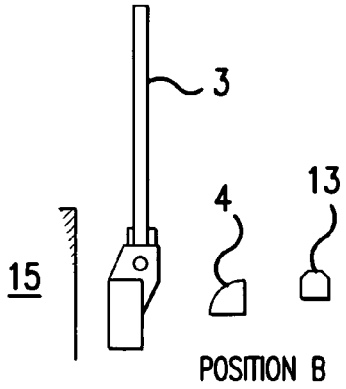
Figure 2C:
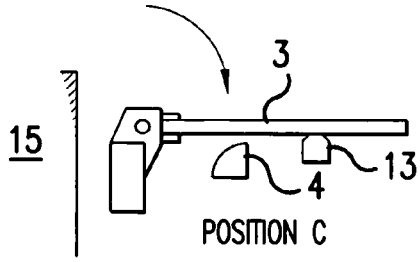
Figure 2A:
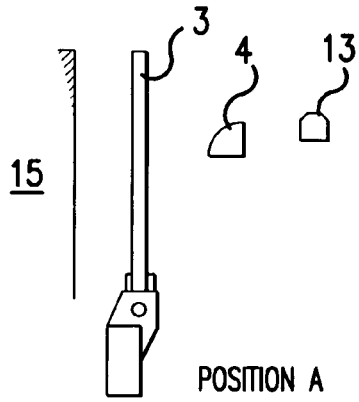
Figure 2D:
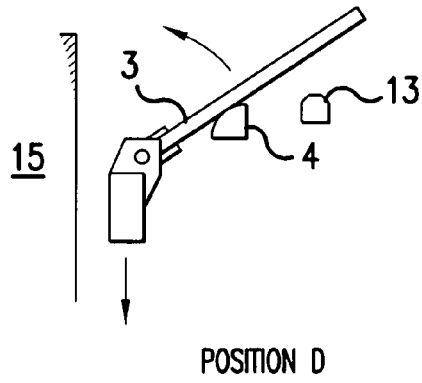

The target system presented in FIGS. 1*a* and 1*b* consists of five main components: a target 3, a carriage 2, guide rails 6, an electric motor 1 with levers 4, 5 and a frame 7. The operation of the system is controlled by a control unit (not shown) provided with a computer. The target 3 is a steel plate impenetrable to a bullet.

The motor 1 located in the lower part of the apparatus moves the carriage 2 along a pair of vertical guide rails 6 by means of levers 4, 5 connected to it. The target 3 is hinged at its lower end on the carriage by horizontal shaft 8 provided in the carriage and a transverse horizontal hole in the lower edge of the target. The levers 4, 5 are connected to the rotating axle 10 of the motor 1 and to a pivot pin 11 at the lower edge of the carriage. In addition, the levers are connected to each other by a pivot pin 12. The motor 1 and the guide rails guiding the carriage may be fixedly mounted on the frame 7.

In position A (FIG. 2*a*), the carriage 2 is in its low position and the target 3 in an upright position but hidden behind a front armour 15. The carriage 2 is raised up by the motor 1, thus bringing the target to position B (FIG. 2*b*) so that it can be shot at. If the target 3 is not hit, then it is lowered along with the carriage 2 back to position A. If the target 3 is hit, then it falls down to position C (FIG. 2*c*), where it is supported by a support part 13. The overturning is registered by a sensor connected to the control unit.

When the carriage 2 is lowered to position D (FIG. 2*d*), the target 3 hits a lifter 14, which, powered by the motion of the carriage and the inertia of the target, returns the target 3 to an upright position, and when the carriage 2 reaches the low position, the system is again in position A. The length of the rails 6 is so chosen that, in position A, the target 3 is completely hidden behind the front armour 15.

The support part 13 and the lifter 14 may be solid or flexible. The support part 13 is located in a position where the translation and rotation of the target 3 are simultaneously cancelled out. The functions of the support part 13 and the lifter 14 can also be integrated in a single component.

In the high position, the target is not strictly upright but slightly forward inclined. This is a stable position and the target can not be overturned e.g. by the wind.

As described above, the target system implements the following three functions: emerging into view, target disappearing from view, and immediate feedback from a hit as target is overturned or the like.

The system consists of distinct modules that can be replaced with new ones when necessary. The target 3 may also consist of two parts 16, 17 attached to each other e.g. with bolts 19, of which parts the upper one is a target part 16 and the lower one a mounting part 17, which has a slot 18 in its upper edge for the target part and in its lower edge a hole 9 for a shaft 8 as mentioned above.

The motor 1 used as a power means can be easily carried along and, when necessary, a likewise portable accumulator can be used a power source.

It is obvious to the person skilled in the art that different embodiments of the invention are not limited to the example described above, but that they may be varied within the scope of the claims presented below. The electric motor may also be a linear motor, in which case no lever arms are needed.

The invention claimed is:

1. A target system for light infantry weapons, comprising:

a target overturnable by an impact; and an actuating mechanism configured to move the target, said target being connected to the actuating mechanism via a pivot structure, wherein the actuating mechanism includes a lifter configured to lift the target to a substantially upright position, a vertical rail system and a carriage vertically moveable along the vertical rail system, and an electric motor configured to move the carriage along the vertical rail system, said pivot structure being arranged on the carriage, wherein the lifter comprises a supporting lifter device, against which the target falls when hit and a non-moveable lifter part arranged below and closer to the rail system than the supporting lifter device such that when the carriage is lowered, the non-moveable lifter part lifts the target to the substantially upright position utilizing the movement of the carriage and an inertia of the target, wherein the target system is portable and of modular construction, wherein the target includes upper and lower parts attached to each other, said upper part being a target part and said lower part being a mounting part, and wherein the lower part includes a slot in an upper surface thereof for receiving the target part and a hole in a lower edge thereof for receiving a shaft included in the carriage.

2. The system of claim 1, further comprising:

a control unit configured to control the electric motor to move the carriage up and down the vertical rail system; and a sensor connected to the control unit and configured to determine whether the target is overturned during the time the target is visible.

3. The system of claim 2, wherein the electric motor moves the carriage vertically up and down the vertical rail system when so ordered by the control unit.

4. The system of claim 1, wherein the upper part comprises a plate-type target and the lower part includes the pivot structure configured to pivot the target between the upright position and the overturned position.

5. The system of claim 1, wherein the supporting lifter device is solid or flexible.

6. The system of claim 1, further comprising:

a protective armor covering at least a portion of a front surface of the target system.

7. The system of claim 6, wherein the vertical rail system extends to a height such that the when the carriage moves the target to its lowest position, the target is hidden behind the protective armor.

8. The system of claim 1, further comprising:

levers connected between a rotating axle of the electric motor and a lower edge of the carriage and configured to move the carriage upwards or downwards along the vertical rails when the rotating axle is rotated.

9. The system of claim 1, wherein the target system is designed to be disassembled without tools for transportation purposes, thus enabling even a single person to move.

10. A target system, comprising:

a target overturnable by an impact;

a carriage configured to carry the target along vertical rails of the target system;

a frame configured to support the vertical rails;

a motor configured to move the carriage along the rails;

a support part fixedly mounted to the frame and configured to support the target when the target is hit by the impact and overturns;

a non-moveable lifter part fixedly mounted to the frame below the support part and configured to lift the target to a substantially upright position when the motor moves the carriage vertically downwards along the rails such that the overturned target contacts the lifter part and lifts substantially upright based on the movement of the carriage and an inertia of the target, wherein the target includes upper and lower parts attached to each other, said upper part being a target part and said lower part being a mounting part, and wherein the lower part includes a slot in an upper surface thereof for receiving the target part and a hole in a lower edge thereof for receiving a shaft included in the carriage.

11. The system of claim 10, wherein the support part and the lifter part are separate parts and operate independent of each other.

12. The system of claim 10, further comprising:

a control unit configured to control the motor to move the carriage up and down the rails; and a sensor connected to the control unit and configured to determine when the target overturns and is supported by the support part.

13. The system of claim 12, wherein the motor moves the carriage vertically down the rails when the sensor detects the target is supported by the support part.

14. The system of claim 10, wherein the support part and the lifter part do not include any moveable parts.

15. The system of claim 10, wherein the support part and the lifter part are integrated into a single component.

16. The system of claim 10, wherein the upper part comprises a plate-type target and the lower part includes a pivot mechanism configured to pivot the target between the upright position and the overturned position.

17. The system of claim 10, wherein the frame, support part, and lifter part are modularly connected without welding.

18. The system of claim 10, wherein the lifter part is solid or flexible.

19. The system of claim 10, further comprising: a protective armor covering at least a front surface of the frame.

20. The system of claim 19, wherein the rails extend to a height such that the when the carriage moves the target to its lowest position, the target is hidden behind the protective armor.

21. The system of claim 10, wherein the motor comprises an electric motor.

* * * * *